US012727682B2

(12) United States Patent
Butler

(10) Patent No.: US 12,727,682 B2
(45) Date of Patent: Sep. 8, 2026

(54) INFANT CRIB

(71) Applicant: Jennifer Butler, House Springs, MO (US)

(72) Inventor: Jennifer Butler, House Springs, MO (US)

( * ) Notice: Subject to any disclaimer, the term of this patent is extended or adjusted under 35 U.S.C. 154(b) by 265 days.

(21) Appl. No.: 18/316,786

(22) Filed: May 12, 2023

(65) Prior Publication Data

US 2024/0374049 A1 Nov. 14, 2024

(51) Int. Cl.
*A47D 9/00* (2006.01)

(52) U.S. Cl.
CPC ..... *A47D 9/00* (2013.01)

(58) Field of Classification Search
CPC ... A47D 9/00; A47D 7/00; A47D 7/02; A47D 9/012
See application file for complete search history.

(56) References Cited

U.S. PATENT DOCUMENTS 2,369,834 A * 2/1945 Lundin ..... A47D 9/012 5/100
3,763,507 A * 10/1973 Propst ..... A47D 7/00 5/100
5,172,435 A * 12/1992 Griffin ..... A47D 9/005 5/98.1
7,055,194 B2 * 6/2006 Arthur ..... A47D 9/012 5/100
8,261,381 B2 * 9/2012 Hallock ..... A61G 7/051 5/613
8,336,136 B1 * 12/2012 Lantos ..... A47L 9/1683 5/100
8,745,780 B2 6/2014 Su
9,021,629 B2 5/2015 Cheng
10,694,866 B2 6/2020 Gallina
2002/0152550 A1 * 10/2002 Tharalson ..... A47D 5/00 5/99.1
2004/0025251 A1 * 2/2004 Arthur ..... A47D 9/012 5/110
2007/0271697 A1 * 11/2007 Martin ..... A47D 9/016 5/99.1
2011/0258776 A1 * 10/2011 Schwartz ..... A47D 7/00 5/100

FOREIGN PATENT DOCUMENTS

CN 110811217 A 2/2020

* cited by examiner

*Primary Examiner* — Fredrick C Conley
(74) *Attorney, Agent, or Firm* — Stinson LLP

(57) ABSTRACT

An infant crib is provided that includes at least one stationary sidewall and a positionable sidewall that is selectively moveable relative to the stationary sidewall between a fully closed position and a fully open position. When the positionable sidewall is in the fully open position a side access opening providing access to an enclosure defined within the infant crib is provided. The positionable sidewall includes a cover that extends over the moveable sidewall. The crib also includes a retaining mechanism assembly including a channel defined therein. At least a portion of the positionable sidewall is sized and shaped to be received within the channel when the moveable sidewall is in the fully closed position. The positionable sidewall is removeable from the retaining mechanism assembly and is selectively moveable by a user using only one hand.

17 Claims, 4 Drawing Sheets

INFANT CRIB

BACKGROUND

The field of the disclosure relates generally to infant cribs, and more particularly, to cribs for infants that include a selectively positionable sidewall.

At least some known infant cribs include an enclosure that provides limited access to an infant by a caregiver, for example, through an opening in the top of the infant crib. The crib sidewalls circumscribe a mattress and define the access opening. In addition, the sidewalls limit the ability of an infant to crawl from the mattress and increase the safety of a sleeping infant. In some cases, a caregiver may elect to place an infant crib in the same room as the caregiver's sleeping bed, to enable the caregiver to readily care for the infant's needs, particularly during sleeping hours. In addition, it is common for a caregiver to hold an infant closely to help the infant fall asleep. Once the infant falls asleep, it may be difficult to return the infant to the crib as the upper opening of the crib requires that a caregiver wanting to return a sleeping infant to its crib must bend awkwardly over the crib sidewalls to return the infant to their crib but must also do so without inadvertently moving or disturbing the infant in any manner that could wake the sleeping infant.

As such, often out of desperation and/or frustration, it may be common for a caregiver to co-sleep with the infant outside of the infant's crib, rather than trying to return the infant to their crib. However, co-sleeping with an infant is considered a hazardous and risky practice that is not recommended by leading pediatric organizations, such as the American Academy of Pediatrics, because of the risk of infant strangulation and/or suffocation, for example. Although many parents are aware of the safe sleep guidelines published by the American Academy of Pediatrics, and although the dangers of bed sharing babies is well documented, some parents may still opt to co-sleep with their baby out of desperation from lack of sleep. In addition, with "gentle parenting" on the rise, more parents than ever before are concerned about the possible adverse psychological effects of sleep training methods that may arise from letting babies cry themselves to sleep without the parents intervening.

In order to increase access to an infant within an enclosure, at least some known bassinettes include a movable sidewall that may be selectively opened and closed to provide access to an infant. Because bassinettes are typically formed with sidewalls that are shorter than a height of those used in cribs, because of fall hazards, most pediatric agencies warn against using a bassinette with any infant over 4-6 months hold or any infant that learning to sit up on their own. In addition, many bassinets also have strict weight limits as low as 10-15 pounds. Moreover, when using a bassinette, effort and care must be taken in order to open the movable sidewall, e.g., using both hands, such that by design, the sidewall cannot be opened by a caregiver using only one hand, while holding an infant or a bottle in their other hand, for example. Moreover, the movable sidewall may obstruct access to the interior of the crib when in a fully open position.

Because the sidewalls are taller in cribs, it may be difficult for a caregiver to reach over the sidewall to retrieve an infant from, or to lay an infant within, the crib enclosure. It should be noted that under the new consumer product safety commission requirements, traditional drop-side cribs can no longer be made or sold because of the risk of the hardware and other parts becoming loose and being swallowed by infants and/or the enabling the drop-side crib wall to entrap or strangle the infant. Moreover, with the traditional drop-side cribs of the past, the moveable sidewall could slip from its track and potentially create a trapping hazard for an infant.

Accordingly, there exists a need for improved infant cribs that overcome the limitations described above.

This Background section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

In one aspect, an infant crib is provided. The infant crib includes a base and a sidewall having a top edge and a bottom edge, the sidewall circumscribes the base and defines an enclosure that is accessible via an opening defined by the top edge. A first portion of the sidewall is fixedly secured in position relative to the base, and a second portion of the sidewall is selectively moveable relative to the base between a fully open position and a fully closed position. The top edge of the first portion of the sidewall is substantially co-planar with the top edge of the second portion of the sidewall, when the second portion of the sidewall is in the fully closed position. When the second portion of the sidewall is in the fully open position, the enclosure is accessible through a side opening created when the second portion of the sidewall has been moved from the fully closed position. The infant crib includes a retaining mechanism assembly coupled to the first portion of the sidewall. The retaining mechanism assembly is oriented to retain the second portion of the sidewall in the fully closed position. The second portion of the sidewall is removeable from the retaining mechanism by a user using only one hand.

In another aspect, an infant crib is provided. The infant crib includes at least one stationary sidewall and a positionable sidewall that is selectively moveable relative to the stationary sidewall between a fully closed position and a fully open position. Wherein when the positionable sidewall is in the fully open position a side access opening providing access to an enclosure defined within the infant crib is provided. The positionable sidewall includes a cover extending at least partially over the moveable sidewall. The crib also includes a retaining mechanism assembly including a channel defined therein. At least a portion of the positionable sidewall is sized and shaped to be received within the channel when the moveable sidewall is in the fully closed position. The positionable sidewall is removeable from the retaining mechanism assembly and is selectively moveable by a user using only one hand.

In yet another aspect, an infant crib assembly selectively positionable adjacent to an adult mattress is provided. The infant crib assembly includes a lower frame sized to support an infant mattress. The infant crib assembly further includes at least one stationary sidewall and a positionable sidewall that is selectively moveable relative to the at least one stationary sidewall between a fully closed position and a fully open position. Wherein when the positionable sidewall is in the fully open position a side access opening is created that provides access to an enclosure defined within the infant crib. The positionable sidewall includes a retaining mechanism assembly including a channel defined therein. At least a portion of the positionable sidewall is sized and shaped to be received within the channel when the positionable sidewall is in the fully closed position. The positionable sidewall is removeable from the retaining mechanism assembly and is selectively moveable by a user using only one hand Various refinements exist of the functions noted in relation to the above-mentioned aspects. Further functions may also be incorporated in the above-mentioned aspects as well. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION

Figure 1:
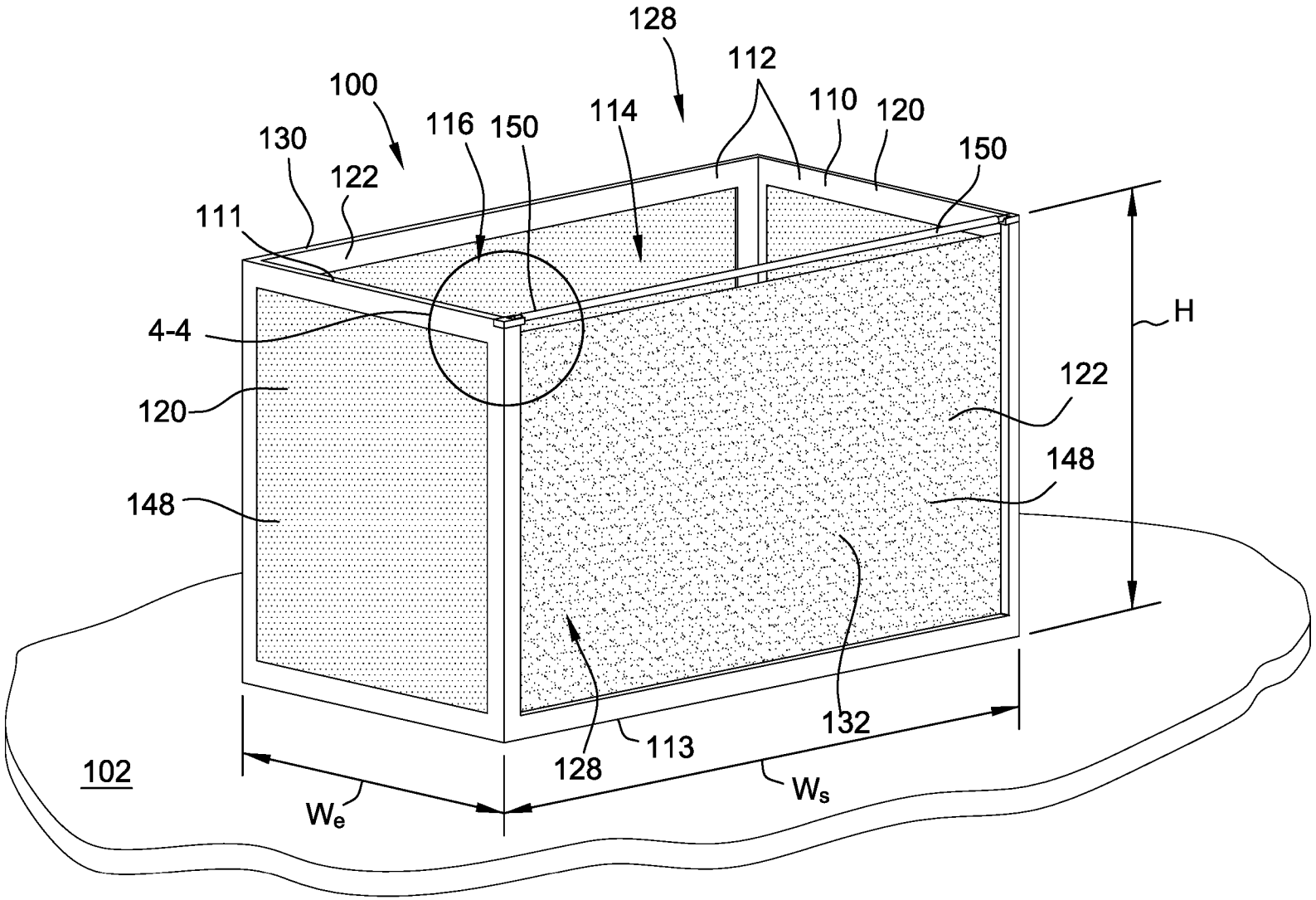
FIG. 1 is a second perspective view of an exemplary infant crib.
Figure 2:
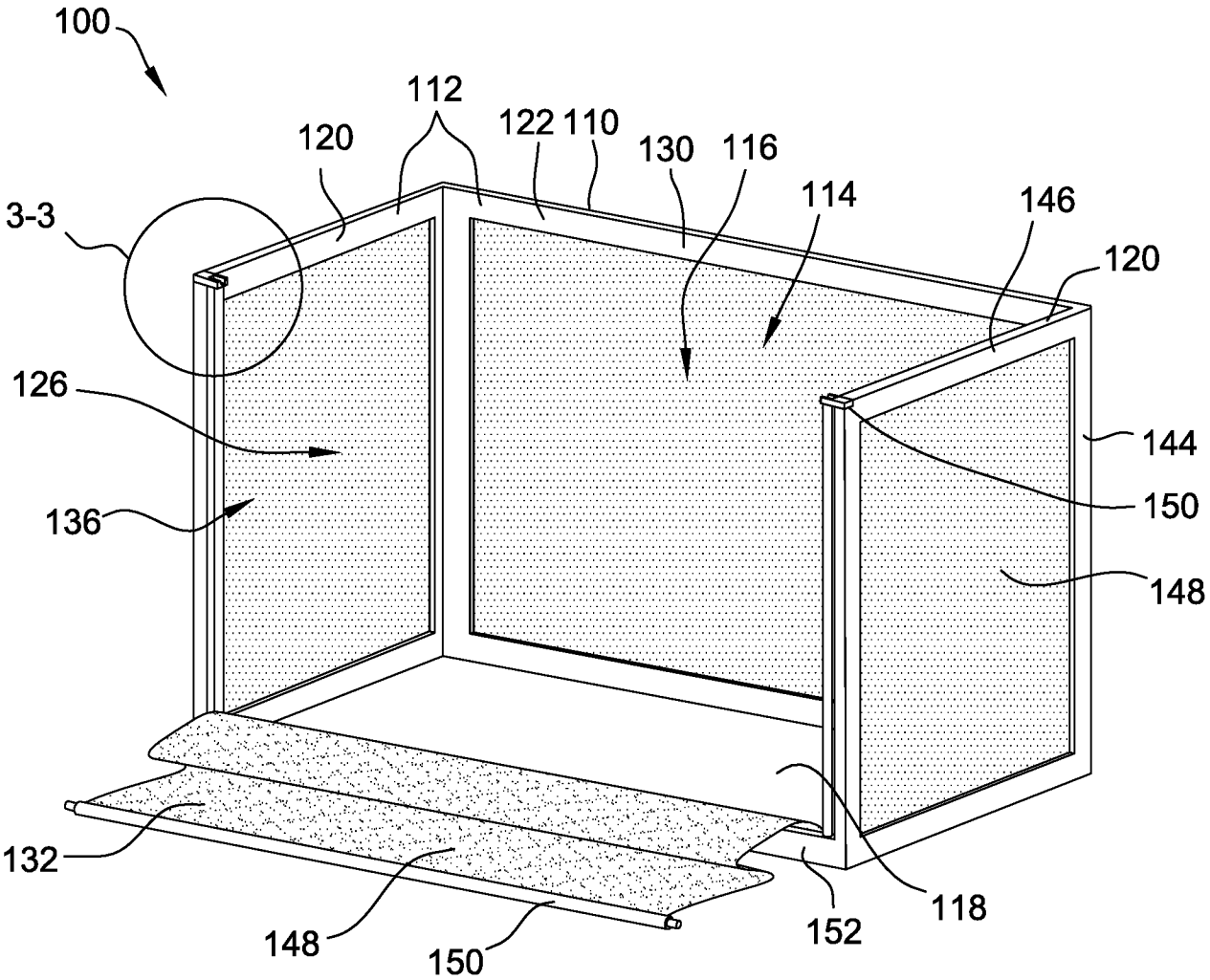
FIG. 2 is a perspective view of the infant crib shown in FIG. 1 including a movable sidewall arranged in a fully open position.

FIG. 1 is a perspective view of an exemplary infant crib, indicated generally by 100. FIG. 2 is a perspective view of infant crib 100 including a movable sidewall 132 arranged in a fully open position 126. In the exemplary embodiment, the crib 100 is positioned on a floor 102. Alternatively, crib 100 may be removably coupled to a lower support (not shown), such as a lower crib frame or a changing table that supports the crib 100 a height above the floor 102. In such embodiments, the crib 100 is generally securely coupled to the lower support in a manner that facilitates preventing the crib 100 from inadvertently falling off the lower support. In other embodiments, crib 100 may be formed integrally with the lower support. In the exemplary embodiment, the crib 100 includes an upper frame 110 that includes at least one wall 112 that defines an interior and an enclosure 114 of the crib 100. In the illustrated embodiment, the crib 100 includes four independent walls 112 that each include an upper edge 111 defining an upper opening 116 and a lower edge 113 that defines a base 118 of the crib 100. In other embodiments, the crib 102 may include more or less than four independent walls 112. For example, the crib 102 may include a pair of semi-elliptical walls that form the base 118 of the crib 102. In the exemplary embodiment, the upper frame 110 is configured such that the wall 112 circumscribes the base 118 and forms a generally rectangular-shaped enclosure 114 defined by a first pair of opposed, parallel endwalls 120, and a second pair of opposed, parallel sidewalls 122. In other embodiments, the wall 112 may define a generally elliptical-shaped enclosure. In some alternative embodiments, the crib 100 may be prism-shaped, wherein one or more of the walls 112 is coupled to an adjacent wall 112 at an angle that is greater than 90°. Alternatively, the crib 100 may have any other suitable shape that enables the crib 100 to function as described herein.

In the exemplary embodiment, the pair of endwalls 120 are oriented generally perpendicular to the second pair of sidewalls 122, and each of sidewalls 122 is wider than each of the endwalls 120. More specifically, in the exemplary embodiment, the sidewalls 122 are oriented such that a standard-sized crib mattress (not shown) fits snugly within the enclosure 114. A standard-sized crib mattress can measure about 27.25 in. wide and about 51.375 in. long. In another embodiment, the sidewalls 122 are oriented such that a standard-sized mini crib mattress (not shown) fits snugly within the enclosure 114. A standard-sized mini crib mattress can measure about 24 in. wide and about 38 in. long.

With respect to the sidewalls 122, in the exemplary embodiment, at least one of the sidewalls 122 is a stationary sidewall 130 that is fixedly secured in position to the upper frame 110, and at least one sidewall 122 is a selectively moveable sidewall 132 that is variably positionable relative to the upper frame 110. Moreover, in the exemplary embodiment, the endwalls 120 are each stationary and each is fixedly secured in position relative to the upper frame 110. Accordingly, in the exemplary embodiment, the enclosure 114 is defined by three walls 112 that are fixedly secured in position relative to the enclosure 114 and one wall 112 that is selectively moveable to provide increased access to the enclosure 114. More specifically, in the exemplary embodiment, sidewall 132 is selectively moveable between a fully open position 126 and a fully closed position 128. In some embodiments, the sidewall 132 may be selectively positioned by a retaining member 150 in pre-defined stop positions that are spaced between the fully open and closed positions 126 and 128, respectively.

In the exemplary embodiment, the crib 100 is rectangular-shaped wherein the sidewalls 122 have a width $W_s$ that is longer than a width We of each of the endwalls 120. The crib 100 has a height H that extends from the base 118 to the upper opening 116. The height H may be any height that enables the sidewalls 122 and the endwalls 120 to extend at least 26" above a standard 6 in. thick crib mattress. Alternatively, the height H may be any height that enables the crib 100 to function as described herein and that enables crib 100 to comply with safety standards issued by the Consumer Product Safety Commission. In some alternative embodiments the crib 100 may be square-shaped. In the exemplary embodiment, each of the walls 112 are generally the same height H. In some alternative embodiments, one or more of the walls 112 may be shorter or taller than at least one of the other walls 112. For example, in some embodiments, the moveable sidewall 132 may be shorter, i.e., have a shorter height, than a height of the stationary sidewalls 130 or the endwalls 120.

In some embodiments, the crib 100 may be supported by a lower crib frame assembly (not shown), such that the crib 100 is supported a height above the floor. In some embodiments, the crib may be coupled to a lower crib frame assembly that may include wheels that enable the crib 100 to be selectively moved, i.e., rolled, to different positions within a house. In the exemplary embodiment, when sidewall 132 is selectively moved to the fully open position 126 or is moved to a partially opened position (not shown), the enclosure 114 of the crib 100 is accessible through a side access opening 136 created by the vacated or moved sidewall 132. As such, when the sidewall 132 is moved, a caregiver may lie next to, or retrieve, an infant within the enclosure 114 by moving the infant through the upper opening 116, and/or more easily, the caregiver may access the enclosure 114 through the side access opening 136 created when the sidewall 132 is in an open position 126.

More specifically, in the exemplary embodiment, the side access opening 136 enables a caregiver to access the infant, and thus lie next to the infant, while the caregiver is lying next to the crib 100. As such, the caregiver may provide comfort and/or care to an infant within the crib 100, while the caregiver is lying prone next to the crib 100, thus enabling the infant to remain in close contact with the caregiver while essentially remaining in their crib 100. More specifically, the side access opening 136 enables the infant to fall asleep in their crib 100 without requiring the caregiver to lift the sleeping infant to into the crib 100. More specifically, in the exemplary embodiment, the crib 100 may be positioned by the caregiver such that the positionable sidewall 132 faces towards the caregiver such that a caregiver may lie next to the infant and to the crib 100. In such a position, the caregiver can contact and access the infant through the side access opening 136, while the stationary sidewall 130 and the endwalls 120 restrict movement of the infant from the enclosure 114 of the crib 100. After an infant is asleep, the caregiver can reposition the moveable sidewall 132 in the fully closed position 128 without having to disturb the sleeping infant. Thus, the crib 100 enables the infant to fall asleep next to the caregiver, while still complying with sleep guidelines of the American Academy of Pediatrics (AAP). Thus, the crib 100 facilitates relieving co-sleep habits between an infant and a caregiver, while enabling compliance with the AAP guidelines.

In the exemplary embodiment, the stationary sidewall 130 and endwalls 120 may each include a fabric covering 148 that extends across an outer frame 140 that supports stationary sidewall 130 and/or endwalls 120. The fabric covering 148 may be a mesh and/or cloth, fabricated from a cotton or nylon material, for example. Alternatively, any other material that is safe for infants may be used that has flexibility and provides breathability. In some embodiments, the stationary sidewall 130 may be formed of a rigid material, such as wood, vinyl, or plastic, for example. In some embodiments, the stationary sidewall 130 and/or the endwalls 120 may be formed with slats. Alternatively, stationary sidewall 130 and/or endwalls 120 may be fabricated from any other material and/or any other type of construction that enables crib 100 to function as described herein.

Figure 3:
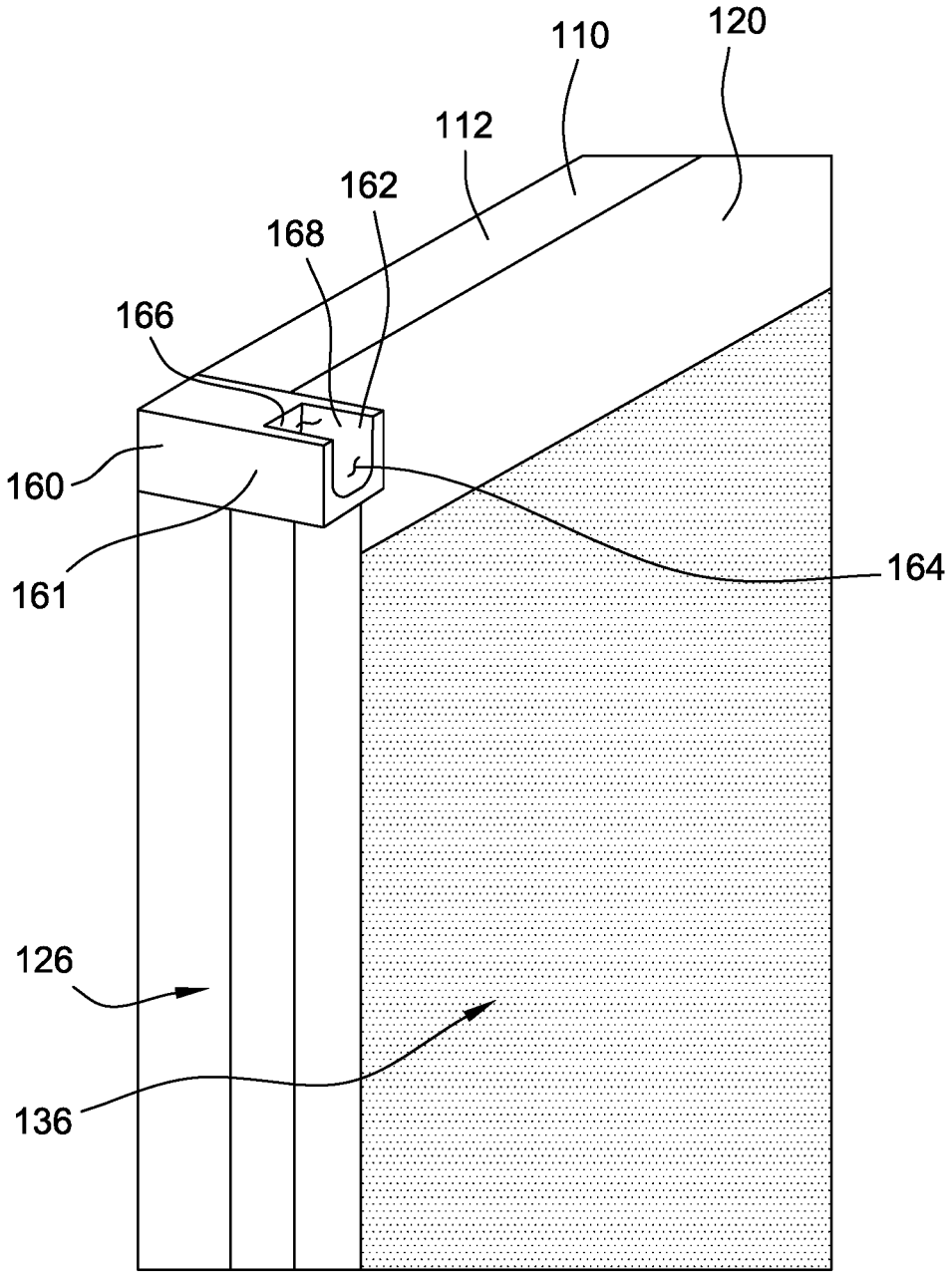
FIG. 3 is an enlarged view of region 3-3 shown in FIG. 2.
Figure 4:
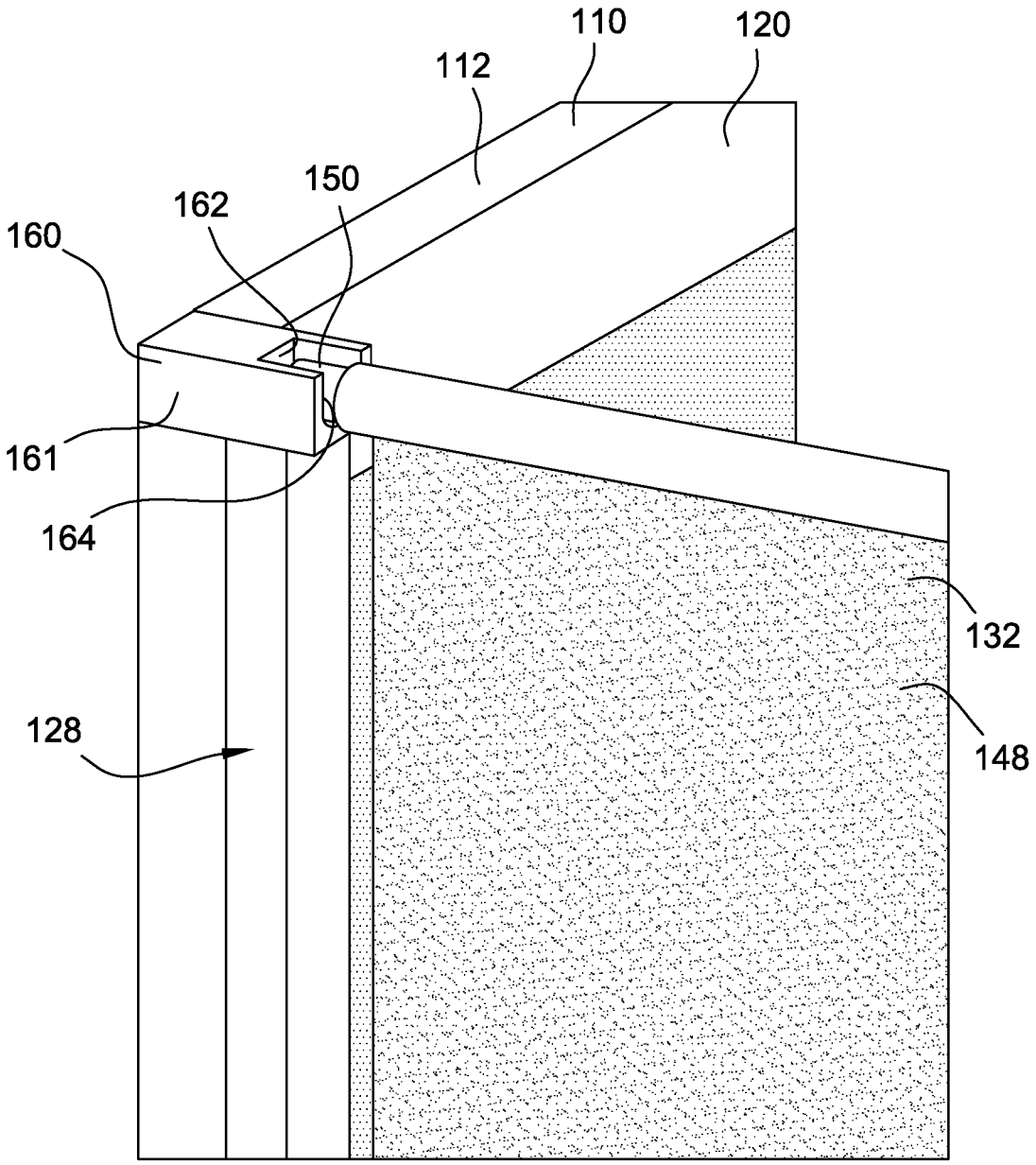
FIG. 4 is an enlarged view of region 4-4 shown in FIG. 1.

With reference to FIGS. 3 and 4, in the exemplary embodiment, the selectively positionable sidewall 132 includes a retaining member 150 that extends generally perpendicularly between the pair of endwalls 120. Sidewall 132 also includes a lower base member 152 that extends across endwalls 120 and across sidewalls 130 and 132. In the exemplary embodiment, lower base member 152 defines a rectangular frame. In each embodiment, lower base member 152 is stationary and circumscribes enclosure 114. In alternative embodiments, lower base member 152 is formed of individual members that are securely coupled together. In some embodiments, a substantially planar bottom base (not shown) extends width-wise and length-wise across base members 152 to support an infant mattress within enclosure 114. In other embodiments, crib 100 does not include a planar bottom base. In the exemplary embodiment, retaining member 150 is a circular rod. In other embodiments, retaining member 150 may include any other retaining member and/or may have any other non-circular cross-sectional shape that enables sidewall 132 to function as described herein. Moreover, although member 150 is illustrated as being the retaining member 150 used to secure sidewall 132 in the fully open position 126, alternatively, sidewall 132 may be constructed with any other style, or with any other retaining mechanism, that enables crib 100 to function as described herein.

In the exemplary embodiment, the cover 148, formed of a flexible and breathable material, is coupled to retaining member 150 and to lower base member 152 such that the cover 148 extends laterally between the endwalls 120. Because sidewall 132 is selectively moveable, in the exemplary embodiment, the covering 148 is flexible to enable sidewall 132 to be selectively collapsed when sidewall 132 is moved towards the fully open position 126 or is positioned at its fully open position 126. Moreover, the covering 148 is sized and fabricated from a material than enables covering 148 to be relatively taut and under tension between endwalls 120 and between members 150 and 152 when sidewall 132 is in the fully closed position 128. Furthermore, sidewall 132 may be selectively raised, i.e., moved towards the upper opening 116 and its fully closed position 128, or may be selectively lowered, i.e., moved towards the base 118 of the crib 100 and towards its fully open position 126.

In some embodiments the covering 148 may be fabricated from a material that intentionally folds in an accordion-style as sidewall 132 is lowered. In other embodiments, covering 148 is biasedly coupled to retaining member 150 and winds around, i.e., wraps around, retaining member 150 as sidewall 132 is lowered in a manner similar to a spring-biased window shade or window blind. In yet other embodiments, covering 148 is biasedly coupled to lower base member 152 and wraps around, i.e., winds around, lower base member 152 as sidewall 132 is lowered. Alternatively, stationary sidewall 130 may be constructed with any other covering 148 that enables stationary sidewall 130 to function as described herein. Moreover, although the positionable sidewall 132 is described as including a covering 148, the positionable sidewall 132 may be fabricated as a rigid design, such as a rigid slatted sidewall, and may be selectively raised and lowered as a sliding positionable sidewall, not shown. The sliding positionable sidewall may hinged, similarly to a solid garage door, wherein positionable sidewall 132 essentially folds forwardly towards a caregiver when in the fully open position 126. In such an embodiment, the positionable sidewall 132 is hinged to rotate relative to the endwalls 120, between the fully open and closed positions 126 and 128, respectively. In some embodiments, the positionable sidewall 132 includes a second member and a biasing mechanism, wherein the second member is rotationally connected to endwalls 120 such that the covering 148 may be wound about the second member as the positionable sidewall 132 is moved into the open position.

In the exemplary embodiment, when positionable sidewall 132 is in the fully open position 126, retaining member 150 is positioned at a relative height, i.e., a vertical location, that is approximately the same height as base 118 or that is approximately the same height as a mattress positioned within enclosure 114. As a result, in the exemplary embodiment, when positionable sidewall 132 is fully opened, there are no obstructions created by sidewall 132 between the upper opening 116 and the infant mattress within the side access opening 136, and as such, a caregiver can access the enclosure 114 through both upper opening 116 and the side access opening 136 simultaneously.

In the exemplary embodiment, when the positionable sidewall 132 is in the fully closed position 128, movement of an infant trying to exit the crib 100 on their own is substantially prevented. Moreover, because the covering 148 is sized to extend tautly and under tension across the side access opening 136 when the positionable sidewall 132 is in the fully closed position 128, positionable sidewall 132 functions substantially identically as stationary sidewall 130 and/or endwalls 120 when in the fully closed position 128, and thus substantially prevents an infant from exiting the crib 100 and/or inadvertently falling from the crib 100. In some embodiments, positionable sidewall 132 is constructed of substantially the same materials as stationary sidewall 130 and/or endwalls 120 such that when in the fully closed position 128, the positionable sidewall 132 appears visually identical to stationary sidewall 130. In other embodiments, sidewalls 130 and 132 may be fabricated differently and/or may be fabricated differently than endwalls 120. In the exemplary embodiment, when positionable sidewall 132 is being moved into the fully closed position 128, covering 148 may be pulled into tension between the retaining member 150 and lower base member 152, and extend tautly across side access opening 136 and between retaining member 150 and lower base member 152, and between the opposing endwalls 120.

In the exemplary embodiment, the positionable sidewall 132 includes a retaining bracket assembly 160, positioned at, or in close proximity, to the upper opening 116 of the crib 100. The retaining bracket 160 assembly may be formed integrally with the upper frame 110 and/or the retaining bracket 160 assembly may be separately formed and securely coupled to upper frame 110. In the illustrated embodiment, the retaining bracket assembly 160 includes a pair of retaining brackets 161 that each extend outwardly from the frame 110 in an opposed relationship, such that each is aligned substantially co-planarly with positionable sidewall 132. In some alternative embodiments, the retaining brackets 161 may extend outwardly from the upper frame 110 and be oriented substantially perpendicularly to wall 112. In other alternative embodiments, the retaining bracket assembly 160 may be offset a distance inwardly from a plane of sidewall 132, towards the stationary sidewall 130. In such an embodiment, the covering 148 will extend over one or more projections (not shown) extending outwardly from each endwall 120. In such an embodiment, the covering wraps over the projections to enable the positionable sidewall 132 to remain substantially perpendicular when in the fully closed position 128 and to enable cover 148 is stretched tautly over side access opening 136.

In alternative embodiments, the crib 100 may also include one or more of the retaining brackets 161, or pairs of retaining brackets 161, positioned at any suitable position between the base 118 and the upper opening 116, such that the positionable sidewall 132 may be selectively positioned in pre-defined partially open positions, while ensuring that the cover 148 remains tautly stretched across side access opening 136.

In the exemplary embodiment, each retaining bracket 161 includes a channel 162 defined therein. More specifically, each channel 162 has a cross-sectional shape that in the exemplary embodiment, substantially mirrors a portion of an outer shape of retaining member 150. Accordingly, in the exemplary embodiment, because retaining member 150 is substantially circular, each channel 162 has a substantially semi-circular shape. Alternatively, retaining member 150 and/or channels 162 may have any other cross-sectional shape or size that enables endwall 120 to function as described herein. Each channel 162 is positioned such that the cavity 164 opens upwardly, e.g., away from the base 118. The channels 162 are sized to receive the retaining member 150 in a snug fit therein when positionable sidewall 132 is in the fully closed position 126.

Sidewall 132 may be selectively moved from a fully closed position 128 towards the open position 126, by lifting retaining member 150 from each channel 162 and allowing sidewall 132 to move downwardly towards base 118. Similarly, sidewall 132 may be selectively moved to, and secured within, the fully closed position 128 by inserting retaining member 150 within the retaining member channels 162. When the retaining member 150 is properly inserted within the each of the retaining member cavities 164, a minimal clearance is defined between the retaining member 150 and each channel 162 defining the cavities 164.

When the retaining member 150 is inserted within the cavity 164, member 150 may be retained within cavity 164 by the channel 162, e.g., a side wall 168 and a back wall 166 of channel 162. The retaining member 150 may be selectively moved out of the cavity 164 by lifting the retaining member 150 upwardly in a vertical direction to move the retaining member 150 out of the channel opening 170 and out of the cavity 164. More specifically, in the exemplary embodiment, the retaining member 150 may be moved upwardly and out of cavity 164, or a pair of cavities 164, using only one hand. Accordingly, a caregiver may reposition the positionable sidewall 132, between the fully closed position 128 and the fully open position 126, using only one hand, and with a minimal force. The upward facing channel 162, prevents an infant from inadvertently moving or opening the positionable sidewall 132 and thus prevents the infant from moving the retaining member 150 out of the cavity 164. For example, an infant placed within the enclosure 114 of the crib 100 may pull or tug on the covering 148, but will not be able to open the positionable sidewall 132 or inadvertently remove retaining member 150 from retaining bracket assembly 160. In some embodiments, crib 100 also includes a locking mechanism (not shown) that prevents retaining member 150 from being lifted from cavities 164 until the locking mechanism is moved.

In the exemplary embodiments described herein an infant crib includes a moveable sidewall that may be selectively opened to provide access through a side of the crib, rather than only from above the crib. The side access enables a caregiver to access the infant while the caregiver is lying next to the crib provide comfort and/or care to an infant within the crib enclosure. A retaining member may be used to hold the positionable wall in the fully closed position, and the retaining member may be moved upward, out of a channel by a caregiver to enable the sidewall to be selectively moved using only one hand. Accordingly, a caregiver may reposition the positionable sidewall, between the fully closed and fully open positions, using only one hand, and using only a minimal force. The upwardly facing channel prevents an infant from inadvertently moving or opening the positionable sidewall, e.g., preventing the infant from moving the retaining member, out of the channel, in a vertical direction. For example, an infant placed within the enclosure of the infant crib may pull/tug on the covering, but will not be able to open the positionable sidewall.

The infant crib described herein overcomes many of the problems and issues associated with known cribs. Caregivers are in need of a product that offers an alternative to both co-sleeping and "cry-it-out" sleep training methods. The infant crib described herein makes it easier to follow the safe-sleep recommendations without compromising infant comfort or caregiver-baby bond. The infant crib includes a selectively positionable sidewall that can be lowered to enable a caregiver to nurse an infant to sleep, and/or to lay next to the infant until the infant drifts to sleep, and then be able to fully close the crib and secure the infant within the crib without having to move the infant or awkwardly lean over a tall crib side to place the infant in the crib.

Unlike cribs of the past that have since been banned, the infant crib described herein does not include any hardware that can create a hazard to an infant and as such cannot malfunction or create a safety hazard with components or hardware that can become loose and/or dislodged over time. Rather, the crib described herein allows a caregiver to hold the infant to sleep and/or lay next to them, then move away and raise the wall without disturbing the infant, offering the best of both worlds-comforting the infant to sleep and providing a safe environment to do so.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing (s) shall be interpreted as illustrative and not in a limiting sense.

What is claimed is:

1. An infant crib comprising:

a lower frame sized to support an infant mattress;

at least one stationary sidewall; and a positionable sidewall including a retaining member, the retaining member comprising a rod that extends between a pair of endwalls of the infant crib, the positionable sidewall coupled to the at least one stationary sidewall such that an enclosure is defined within the infant crib, the positionable sidewall selectively moveable relative to the at least one stationary sidewall between a fully closed position and a fully open position, wherein when the positionable sidewall is in the fully open position a side access opening is created that provides access to the enclosure defined within the infant crib, wherein the positionable sidewall includes a retaining mechanism assembly including at least two retaining brackets that each include an upwardly-opening channel defined therein, the channels sized to receive the rod therein in a snug fit when the positionable sidewall is in the fully closed position, wherein the positionable sidewall is removeable from the retaining mechanism assembly by a user using only one hand.

2. The infant crib of claim 1, wherein the positionable sidewall includes a cover formed of a mesh material that enables the sidewall to be selectively collapsed when moved towards the fully open position, the cover sized to extend tautly across the positionable sidewall when in the fully closed position.

3. An infant crib comprising:

a base;

a sidewall having a top edge and a bottom edge, the sidewall circumscribes the base and defines an enclosure that is accessible via an opening defined by the top edge, a first portion of the sidewall is fixedly secured in position relative to the base, a second portion of the sidewall is selectively moveable relative to the base between a fully open position and a fully closed position, the second portion of the sidewall including a retaining member that comprises a rod that extends between a pair of endwalls of the infant crib, wherein the top edge of the first portion of the sidewall is substantially co-planar with the top edge of the second portion of the sidewall when the second portion of the sidewall is in the fully closed position, and wherein when the second portion of the sidewall is in the fully open position, the enclosure is accessible through a side opening created when the second portion of the sidewall has been vacated from the fully closed position; and a retaining mechanism assembly coupled to the first portion of the sidewall and oriented to retain the second portion of the sidewall in the fully closed position, the retaining mechanism assembly including a channel that opens upwardly away from the base and is sized to receive the rod of the retaining member therein in a snug fit, when the second portion of the sidewall is in the fully closed position, wherein the second portion of the sidewall is removeable from the retaining mechanism assembly by a user using only one hand by lifting the retaining member upwardly out of the channel.

4. The infant crib of claim 3, wherein the retaining member has a circular cross-sectional shape.

5. The infant crib of claim 4, wherein the retaining member shape substantially mirrors a portion of the second portion of the sidewall.

6. The infant crib of claim 3, wherein the retaining mechanism assembly includes at least two retaining brackets that each include the channel defined therein, and wherein the at least two retaining brackets are each coupled substantially co-planarly with the second portion of the sidewall.

7. The infant crib of claim 3, wherein the second portion of the sidewall includes a cover formed of a mesh material that facilitates improved flexibility and breathability.

8. The infant crib of claim 3, wherein the enclosure of the infant crib is accessible through an upper opening when the second portion of the sidewall is in the fully closed position, and through the upper opening and a sidewall opening, when the second portion of the sidewall is in the fully open position.

9. The infant crib of claim 3, wherein the base is sized to support an infant mattress.

10. The infant crib of claim 3, wherein the second portion of the sidewall includes a second member that is rotationally coupled to the first portion of the sidewall of the infant crib and wherein a covering coupled to the second member such that the covering winds about the second member as the second portion of the sidewall is moved into the fully open position.

11. The infant crib of claim 3, wherein the second portion of the sidewall is covered by a mesh material that extends laterally between the endwalls and tautly across the second portion of the sidewall when in the fully closed position, wherein the sidewall is selectively collapsable when moved towards the fully open position.

12. An infant crib comprising:

at least one stationary sidewall; and a positionable sidewall that is selectively moveable relative to the stationary sidewall between a fully closed position and a fully open position, the positionable sidewall including a cover formed at least partially from a mesh material that extends tautly across at least a portion of the positionable sidewall when in the fully closed position and is selectively collapsable when moved towards the fully open position, the positionable sidewall and the at least one stationary sidewall cooperate to define an enclosure within the infant crib, wherein when the positionable sidewall is in the fully open position, a side access opening providing access to the enclosure is provided, wherein the positionable sidewall includes a retaining member that extends between a pair of endwalls of the infant crib, wherein the positionable sidewall comprises a retaining mechanism assembly including a channel defined therein that is sized to receive the retaining member therein in a snug fit, wherein at least a portion of the positionable sidewall is sized and shaped to be received within the channel when the positionable sidewall is in the fully closed position, wherein the positionable sidewall is removeable from the retaining mechanism assembly by a user using only one hand.

13. The infant crib of claim 12, wherein the channel has a cross-sectional shape that substantially mirrors a portion of the positionable sidewall.

14. The infant crib of claim 12, wherein the channel is defined by a semi-circular shaped cavity that faces upwardly away from a base of the infant crib.

15. The infant crib of claim 12, wherein the infant crib further includes a pair of channels.

16. The infant crib of claim 12, wherein the retaining mechanism assembly channel is aligned substantially coplanarly with the positionable sidewall.

17. The infant crib of claim 12, wherein the base supports an infant mattress.

* * * * *